United States Patent [19]

Ikushima et al.

[11] Patent Number: 4,692,132

[45] Date of Patent: Sep. 8, 1987

[54] PROCESS FOR PREPARING A SEALED LAMINATED VESSEL

[75] Inventors: Fumio Ikushima, Yokohama; Senji Itoh, Ayase; Kiyonori Kogashiwa, Yokohama, all of Japan

[73] Assignee: Toyo Seikan Kaisha, Ltd., Tokyo, Japan

[21] Appl. No.: 829,938

[22] Filed: Feb. 18, 1986

Related U.S. Application Data

[60] Division of Ser. No. 681,086, Dec. 13, 1984, which is a continuation of Ser. No. 507,921, Jun. 27, 1983, abandoned.

[30] Foreign Application Priority Data

Jun. 30, 1982 [JP] Japan ..... 57-111475
Jul. 9, 1982 [JP] Japan ..... 57-118430
Jul. 19, 1982 [JP] Japan ..... 57-124430

[51] Int. Cl.[4] ..... B31B 9/64; B31B 1/90

[52] U.S. Cl. ..... 493/103; 493/109; 493/110; 413/6; 413/31; 229/5.6; 229/48 T; 220/67; 220/76; 220/450; 220/458

[58] Field of Search ..... 493/103, 104, 108, 109, 493/308; 413/2, 6, 31

[56] References Cited

U.S. PATENT DOCUMENTS

| | | | |
|---|---|---|---|
| 770,948 | 9/1904 | Adriance et al. | 413/6 |
| 1,343,724 | 6/1920 | Hulbert | 493/104 |
| 1,667,888 | 5/1928 | Graham | 413/4 |
| 2,082,801 | 6/1937 | Kueffner | 229/5.6 |
| 2,188,497 | 1/1940 | Calva | 229/5.6 |
| 2,327,731 | 8/1943 | McClary | 413/6 |
| 2,362,846 | 11/1944 | O'Brien | 493/109 |
| 2,633,095 | 3/1953 | Magill et al. | 493/109 |
| 2,795,264 | 6/1957 | Pechy | 229/48 R |
| 3,406,891 | 10/1968 | Buchner et al. | 229/3.5 MF |
| 3,416,476 | 12/1968 | Wyss | 413/6 |
| 3,428,239 | 2/1969 | Wannamaker et al. | 229/5.8 |
| 3,448,891 | 6/1969 | Czarnecki | 220/74 |
| 3,550,832 | 12/1970 | Fitzgerald | 229/5.6 |
| 3,581,972 | 6/1971 | Buchner et al. | 229/4.5 |
| 3,882,763 | 5/1975 | Ellerbrock et al. | 493/103 |
| 3,912,154 | 10/1975 | Godar | 229/5.5 |
| 3,949,927 | 4/1976 | Smith et al. | 229/5.5 |
| 3,952,677 | 4/1976 | Hartman et al. | 220/67 |
| 3,979,048 | 9/1976 | Stark et al. | 229/48 T |
| 4,037,550 | 7/1977 | Zofko | 220/67 |
| 4,190,187 | 2/1980 | Nelms . | |
| 4,289,265 | 9/1981 | Ellerbrock | 229/5.5 |
| 4,296,745 | 9/1981 | Fukuoka | 229/4.5 |

*Primary Examiner*—Frederick R. Schmidt
*Assistant Examiner*—William E. Terrell
*Attorney, Agent, or Firm*—Sherman and Shalloway

[57] ABSTRACT

A sealed laminated vessel is formed from a barrel composed of a laminate including a paper substrate and a metal foil with inner and outer heat-sealable resin layers on both surfaces lapped together to form a straight side seam and a lid member on at least one open end thereof formed from a laminate of a metal foil and heat-sealable resin layer which is heat sealed to a circumferential end edge portion of the barrel. The vessel is formed by a process which includes forming a flat circumferential end portion of the barrel by bending at least one open end of the barrel outwardly and thereafter inwardly bending a part of the bent portion in the reverse direction so that it is lapped on the lower side of the remaining part of the bent portion to form a flat circumferential end portion on at least one open end of the barrel.- The lid member is thereafter heat-sealed to the circumferential portion of the barrel through the heat-sealable resin layer of the lid member. Finally, the heat-sealed portion of the lid member and the circumferential end portion of the barrel are mechanically lap-seamed using a molding roller having a section conforming to the final shape of the sealed portion. As a result a horizontal flange wall in the peripheral portion of the lid member is downwardly bent together with the circumferential end portion of the barrel. Accordingly, heat sealing is uniformly effected and the sealing property is further improved by the mechanical lap seaming to form a tightly sealed laminated vessel.

5 Claims, 18 Drawing Figures

1
3
5
6
7a
7b
7c
7d
10a
11a
12a
13a
14a
19
20a
23

Fig. 14-C
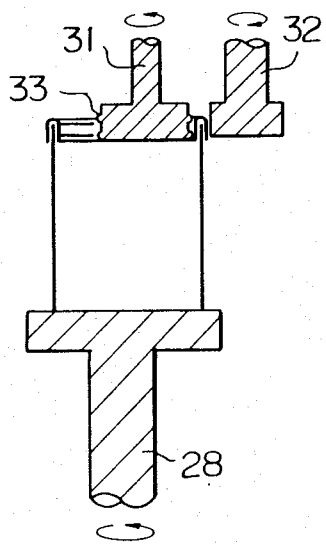
Fig. 14-B
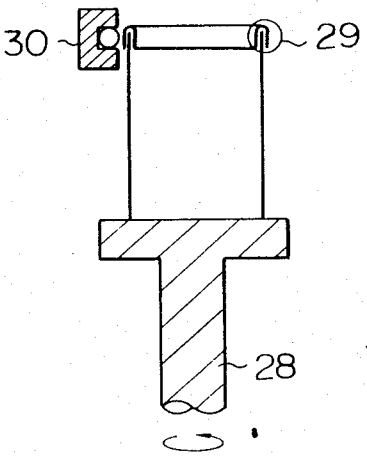
Fig. 14-A
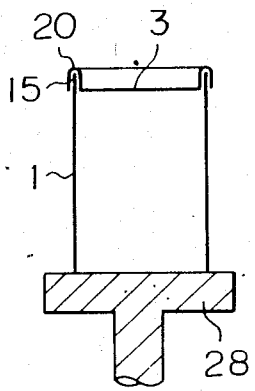

PROCESS FOR PREPARING A SEALED LAMINATED VESSEL

This application is a division of pending application Ser. No. 681,006, filed Dec. 13, 1984, which in turn is a continuation of application Ser. No. 507,921, filed June 27, 1983, now abandoned.

BACKGROUND OF THE INVENTION (1) Field of the Invention:

The present invention relates to a process for preparing a sealed laminated vessel. More particularly, the present invention relates to a laminated vessel in which an excellent seal is formed between the open end of the barrel portion of the vessel and a lid member by heat sealing and mechanical lap-seaming notwithstanding the presence of a seam step.

(2) Description of the Prior Art:

A laminated sheet which comprises a paper substrate, a metal foil and inner and outer surface layers of a heat-sealable resin has been widely used as a material having excellent storage property. When this laminated sheet is formed into a sealed vessel, the end edges of the laminated sheet are piled together and heat-sealed to form a cylindrical or tapered barrel portion having a seam and a lid member is attached to at least one open end of the barrel portion by heat sealing.

However, a sealed vessel having this heat-sealed structure is defective in that it is often difficult to securely bond the lid to the barrel portion. More specifically, in the first place, in case of a vessel of a rigid material having a processability, such as a metal can, secure sealing can be attained by attaching the peripheral edge portion of a lid to the flange of a can barrel through a sealing compound and double-seaming the flange and the peripheral portion of the can lid, but in case of a laminated sheet including paper, the double-seaming operation is impossible and a seal is formed only by heat sealing. Accordingly, various problems described below arise in case of a laminated sheet including paper. When the heat sealing operation is performed, if the portion to be bonded is flat and two-dimensional as in case of sealing of ends of a bag-like vessel or formation of a side seam in a cylindrical vessel, the operation is relatively easy and a seal having a high reliability can be obtained, but if the portion to be bonded is three-dimensional and has no sufficient area as in case of bonding of the peripheral edge portion of a lid to the open end edge of a barrel portion, the heat sealing operation is not always easy and it is difficult to securely form a seal having a high reliability along the entire circumference of the heat-sealed portion.

In the second place, a very large step is formed between a seam formed by lap bonding and a portion other than the seam in the open edge portion, to be heat-sealed, of the barrel, and leakage is readily caused in this step portion. If the thickness of the barrel wall of the vessel is d; a step having a height of 2d is formed when a double-wall structure is formed in the end edge portion, and a step having a height of 3d is formed when a triple-wall structure is formed in the end edge portion. Thus, a very large step is formed between the seam and the portion other than the seam. Under ordinary heat sealing conditions, it is difficult to completely fill this step portion with a heat-sealable resin between the lid member and the end edge of the barrel portion, and it is substantially impossible to completely avoid leakage.

In case of a composite vessel formed by heat-sealing a laminate comprising a paper substrate, adsorption water in the paper substrate is evaporated by heating conducted at the step of heat-sealing the resin layer to form bubbles in the resin layer to be heat-sealed, and the sealing property of the heat-sealed portion is further reduced.

Moreover, in this composite vessel, if the cut edge of the laminate is exposed to the open end of the barrel portion, permeation of water or water vapor is caused through the exposed portion of the paper substrate, resulting in reduction of the shape-retaining property, mechanical strength and content storage property of the vessel.

SUMMARY OF THE INVENTION

It is therefore a primary object of the present invention to provide a sealed vessel having a three-piece structure comprising a cylindrical or tapered barrel portion formed from a laminate including a metal foil and a paper substrate, and lid members, in which the sealing property is highly improved in the heat-sealed portion.

Another object of the present invention is to provide a sealed laminated vessel in which even if a step is formed in the open end portion of the barrel, by a side seam of the barrel of the vessel or a protecting layer covering the side seam, a secure seal can be formed between the barrel and lid member even in this step portion.

Still another object of the present invention is to provide a sealed vessel having a circumferential three-dimensional heat-sealed portion formed between a lid member and the open end of a barrel portion, in which a seal is formed by heat sealing so that leakage is prevented along the entire circumference of the circumferential heat-sealed portion.

A further object of the present invention is to provide a sealed vessel comprising a vessel barrel composed of a laminate having a shape-retaining property and comprising a metal foil, paper and a heat-sealable resin, in which permeation of water and various gases from the cut edge of the laminate is effectively prevented.

A still further object of the present invention is to provide a sealed vessel in which a reliable seal structure is securely formed between the circumferential end edge portion of a cylindrical or tapered barrel of the vessel and the peripheral edge of a lid member and problems such as exposure of a paper substrate in the cut edge of a laminate and foaming of the heat-sealed layer due to water vapor generated from the paper substrate are effectively solved.

In accordance with one aspect of the present invention, there is provided a sealed laminated vessel comprising a barrel which is composed of a laminate comprising a metal foil, paper and inner and outer heat-sealable resin layers and has a straight seam on the side surface thereof and a heat-sealable resin layer covering at least the inner side of the seam, a circumferential end edge portion for heat sealing being formed on at least one open end portion of the barrel by outwardly bending or curling the free end thereof, a lid member which is composed of a laminate having a metal foil and a heat-sealable resin inner layer and has on the periphery thereof a groove or flange engaged with said circumferential end edge portion, and a heat-sealed portion formed between the circumferential end edge portion of the barrel and the groove or flange of the lid member.

wherein in the peripheral end heat-sealed portion formed by the lap-seaming, the thickness of the heat-sealable resin layer between the metal foil of the barrel and the metal foil of the lid member is 0.2 to 0.7 times the total thickness of the heat-sealable resin inner layers of the barrel and lid member or the total thickness of the heat-sealable resin inner layers of the barrel and lid member and the heat-sealable resin covering layer, and the heat-sealable resin is filled in a step formed between both the metal foils contiguous to the peripheral end heat-sealed portion substantially completely.

In accordance with another aspect of the present invention, there is provided a sealed laminated vessel as set forth above, wherein in the barrel of the vessel, the metal foil is located on the inner side and the paper substrate is located on the outer side, the circumferential end edge portion of the barrel has a three-wall structure in which the peripheral end edge portion of the laminate is outwardly curled or bent and the cut edge of the laminate is wrapped in the bent or curled portion, the inner or top wall of the groove of the lid member is bonded to the innermost or topmost wall of the circumferential end edge portion by heat sealing, the outer or lower wall of the groove of the lid member is bonded to the outermost or lowermost wall of the circumferential end edge portion, and a liquid-tight pressing contact is maintained between either the innermost or topmost wall of the circumferential end edge portion of the barrel and the intermediate layer of the circumferential end edge portion thereof by the elasticity of the paper substrate which is pressed into the groove of the lid member having a rigidity.

In accordance with still another aspect of the present invention, there is provided a sealed laminated vessel as set forth above, wherein in the heat-sealed portion between the circumferential end edge portion and the groove or flange of the lid member, a plurality of grooves where the circumferential end edge portion and the lid member are tightly engaged and heat-bonded are formed at small intervals, and a plurality of strongly bonded portions corresponding to said heat-bonding grooves and weakly bonded portions or non-bonded portions corresponding to intervals between every two adjacent heat-bonding grooves are made present in optional directions passing through the circumferential heat-bonded portion.

In a specific aspect of the present invention, there is provided a process for the preparation of a sealed laminated vessel which includes the steps of (i) providing a laminate including a paper substrate and a metal foil and having heat-sealable resin layers on both surface portions of the substrate and the foil, (ii) applying a heat-sealable resin layer to at least a portion of the laminate to be formed into an inner side of a seam to cover a cut edge of the paper substrate, (iii) forming the laminate into a cylinder so that the metal foil is located on the inner side and the paper substrate is located on the other side and lap-bonding an inner end of the laminate to an outer end of the laminate by heat sealing to form a barrel having a straight seam on the side surface thereof, (iv) bending outwardly the laminate on at least one open end of the barrel and bending inwardly a part of the bent portion so that it is lapped on the lower side of the remaining part of the bent portion to form a flat circumferential end portion on at least one open end of the barrel, (v) providing a lid member composed of a laminate which includes a heat-sealable resin layer and a metal foil, the lid member having The present invention will now be described in detail with reference to the accompanying drawings.

BRIEF DESCRIPTION OF THE DRAWINGS

FIG. 7 is a vertically enlarged sectional view showing the heat-sealed portion of the vessel according to the present invention.

FIGS. 8-1 and 8-2 are sectional views showing another example of the protecting layer covering the cut edge of the laminate.

FIGS. 9-1 and 9-2 are sectional views showing still another example of the protecting layer covering the cut edge of the laminate.

FIGS. 14-A, 14-B and 14-C are diagrams showing the steps of the method for producing the vessel of the present invention.

DETAILED DESCRIPTION OF THE PREFERRED EMBODIMENTS

Figure 1:
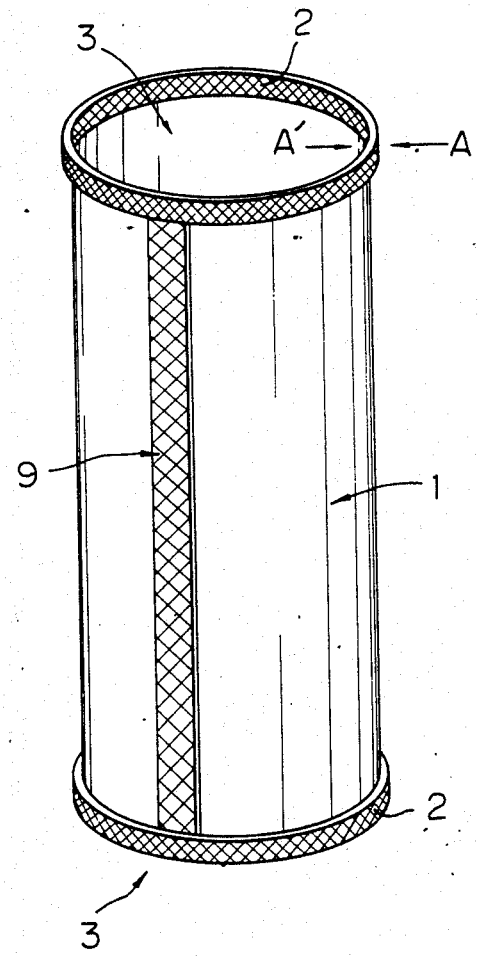
FIG. 1 is a perspective view showing a sealed laminated vessel according to the present invention.
Figure 2:
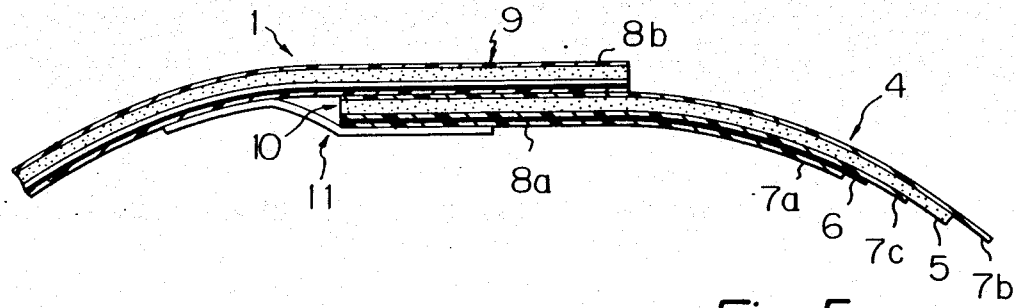
FIG. 2 is a horizontally enlarged sectional view showing the seam of the vessel shown in FIG. 1.

Referring to FIG. 1 showing the entire structure of the sealed vessel of the present invention, this sealed vessel comprises a cylindrical barrel 1 having openings on both the ends and lids 3 sealed and engaged with both the open ends of the cylindrical barrel 1 through a heat sealing portion 2. Referring to FIG. 2, a laminate 4 constituting the cylindrical barrel 1 comprises a paper substrate 5 and a metal foil 6, and heat-sealable resin layers *7a* and *7b* are formed on both the surfaces, respectively. In the embodiment illustrated in FIG. 2, the paper substrate 5 is bonded to the metal foil 6 through a heat-sealable resin layer *7c*.

In the barrel of the sealed vessel of the present invention, in order to obtain a good content storage property, the metal foil 6 is arranged on the inner side of the vessel and the paper substrate 5 is located on the outer side of the vessel. Accordingly, as shown in FIG. 2, the laminate 4 constituting the cylindrical barrel 1 has a layer structure in which the heat-sealable resin layer *7a*, the metal foil 6, the heat-sealable resin layer *7c*, the paper substrate 5 and the heat-sealable resin layer *7b* are arranged in sequence from the inner side toward the outer side.

This laminate 4 is curled into a cylinder so that the metal foil 6 is located on the inner side and the paper substrate 5 is located on the outer side, and the inner end edge 8*a* is lap-bonded to the outer end edge 8*b* by heat sealing to form a straight side seam as shown in FIG. 1. The cut edge 10 where the paper substrate 5 is exposed is located on the inner side of the seam 9. A tape 11 of a heat-sealable resin is applied to cover this cut edge 10, and the tape 11 is bonded to the inner resin layer 7*a* of the laminate 4 by heat sealing.

Figure 3:
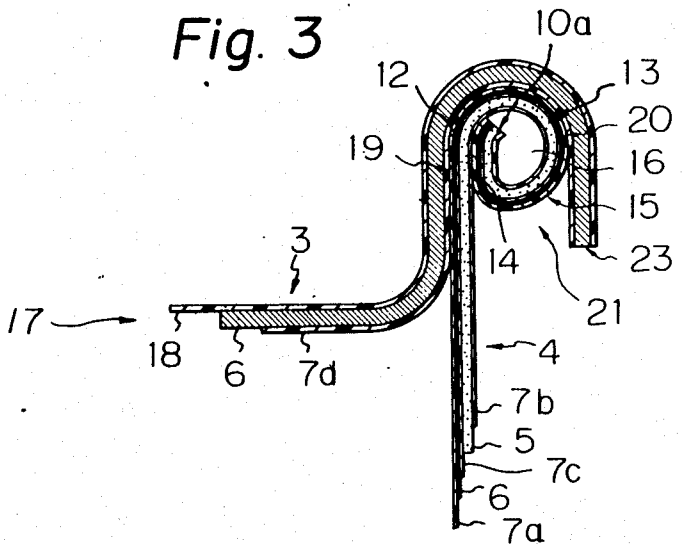
FIG. 3 is a vertically enlarged sectional view showing the engaging portion between a barrel of the vessel shown in FIG. 1 and a lid member before heat sealing.

In the present invention, in each of both the open end portions of the barrel of the vessel, as shown in FIG. 3, the laminate 4 is outwardly curled so that the metal foil 6 is located on the outer side and the paper substrate 5 is located on the inner side and the upper or lower cut edge 10*a* of the laminate 4 is included in the curled portion to form a triple-wall structure, that is, a circumferential end edge portion 15 comprising an innermost wall 12, an outermost wall 13 and an intermediate wall 14. In this stage, the circumferential end edge portion 15 has an annular section and a closed void 16 is formed therewithin, and the cut edge 10*a* is exposed to the void 16.

A laminate 17 constituting a lid member 3 comprises a metal foil 6 arranged on the outer side and a heat-sealable resin layer 7*d* arranged on the inner side, and a protecting resin layer 18 is formed on the outer surface of the metal foil 6. A peripheral groove 21 having a U-shaped section is formed between an inner wall 19 and an outer wall 20 in the peripheral portion of the lid member 3, and the circumferential end edge portion 15 of the cylindrical barrel 1 is inserted in the groove 21 to engage the lid member 3 with the cylindrical barrel 1.

Figure 4:
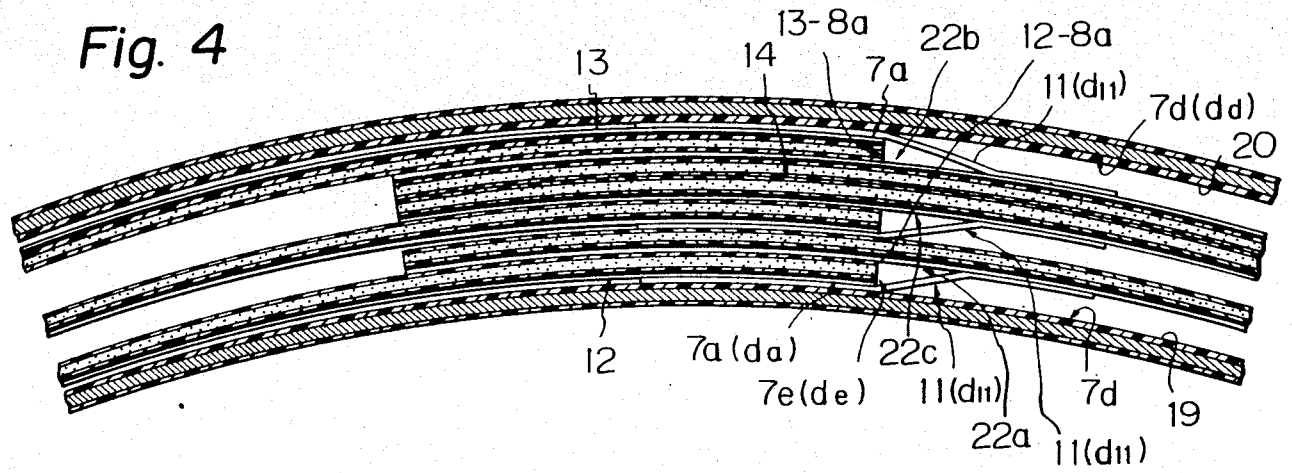
FIG. 4 is a horizontally enlarged sectional view showing the engaging portion shown in FIG. 3.

Referring to FIG. 4 showing in an enlarged state the horizontal section of the engaging portion between the circumferential end edge portion 15 of the barrel and the groove 21 of the lid member, a step 22*a* having a size corresponding substantially to the thickness of the laminate 4 is present between the inner edge 12-8*a* of the innermost wall seam and the innermost wall 12, and a step 22*b* having a similar size is present between the outer edge 13-8*a* of the outermost wall seam and the outermost wall 13. Furthermore, a void portion 22*c* having a size corresponding to the thickness of the laminate 4 is present between the innermost wall 12 and the intermediate wall 14, and because of the presence of this void portion 22*c*, the innermost wall 12 and outermost wall 13 are readily deformed outwardly and inwardly, respectively. Accordingly, the steps or voids 22*a* and 22*b* become larger and it becomes difficult to completely bond the resin layer 7*d* of the lid member 3 to the resin layer 7*a* of the innermost wall 12 or outermost wall 13 in this step 22*a* or 22*b*. Therefore, a void portion connecting the interior of the vessel with the outer atmosphere is formed in each of the steps 22*a* and 22*b* and leakage is caused from this void portion.

In the present invention, in order to eliminate this void portion, the curled edge portion 15 and the lid groove 21, which are engaged with each other in the state shown in FIGS. 3 and 4, are compressed by pressing the inner wall 19 and outer wall 20 of the lid member 3 in the radial direction and heat sealing is carried out under conditions described in detail hereinafter.

In the present invention, heat sealing is carried out under such high pressure conditions that the following requirement is satisfied:

$$de=\alpha(da+dd+d11)$$

wherein de stands for the thickness of the heat-sealable resin layer present between the metal foil 6 of the barrel 1 and the metal foil 6 of the lid member 3 on the inner and outer edges of the seam, da stands for the thickness of the heat-sealable resin layer 7*a* of the barrel 1, dd stands for the thickness of the heat-sealable resin layer 7*d* of the lid member 3, d11 stands for the thickness of the covering heat-sealable resin layer in the case where the resin layer 11 is present, and $\alpha$ is a number of from 0.2 to 0.7, especially from 0.4 to 0.6.

Figure 6:
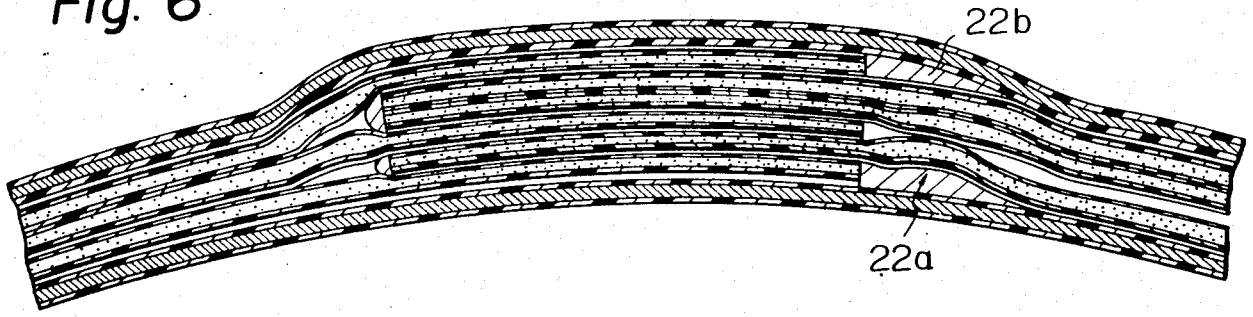
FIG. 6 is a horizontally enlarged sectional view showing the heat-sealed portion shown in FIG. 5.

If heat sealing is carried out under the above-mentioned high pressure conditions, as shown in FIG. 6 illustrating in an enlarged state the horizontal section of the heat sealing portion, the heat-sealable resin located on the seam of the circumferential end edge portion is caused to flow into the steps 22*a* and 22*b* and fill these steps substantially completely, whereby complete blocking or sealing is accomplished with the heat-sealable resin.

Figure 5:
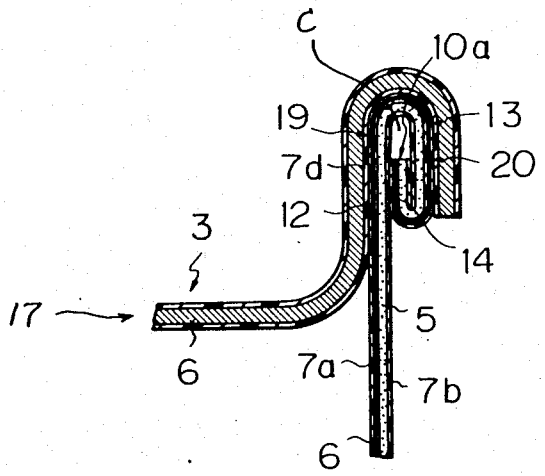
FIG. 5 is a vertically enlarged sectional view showing the heat-sealed portion of the vessel shown in FIG. 1.

Referring to FIG. 5 illustrating in an enlarged state the vertical section of the engaging portion between the lid member 3 and the barrel 1 after heat sealing, according to one preferred embodiment of the present invention, a curled circumferential end edge portion 15 having a triple-wall structure as shown in FIG. 3 is used and heat sealing is carried out under such conditions that the circumferential end edge portion 15 gripped between the inner wall 19 and outer wall 20 of the lid member 3 is compressed, whereby a secure seal is formed by heat sealing under a high pressure between the heat-sealable resin layer 7*d* of the inner wall 19 of the lid and the heat-sealable resin layer 7*a* of the innermost wall 12 on the end edge portion and also between the heat-sealable resin layer 7*d* and the heat-sealable resin layer 7*a* of the outermost wall 13 on the end edge portion. Furthermore, under such high pressure heat-sealing conditions, a liquid-tight contact can be maintained between the heat-sealable resin layer 7*a* of the intermediate wall 14 on the end edge portion contiguous to the cut edge 10*a* of the laminate and the heat-sealable resin layer 7*b* of the innermost wall 12 on the end edge portion by the elasticity of the paper substrate 5 held in the compressed state in the circumferential groove 13 of the lid member having a rigidity. Accordingly, the cut edge 10*a* of the laminate is confined in the state completely surrounded by the metal foil 6 and heat-sealable resin layers, and permeation of water or water vapor through the paper substrate 5 exposed to this cut edge 10*a* is prevented.

In the above-mentioned embodiment of the present invention, as pointed out hereinbefore, in the curled portion 15 the metal foil 6 is located on the side outer than the paper substrate 5, the heat-sealable resin layer 7*a* is formed on the metal foil 6 and heat sealing of the end edge portion having a triple wall structure is carried out under a high pressure, namely under compressive conditions. By virtue of these features, even if steps as mentioned above are present, a strong and secure seal is formed by heat sealing and the cut edge 10*a* of the laminate can be confined.

In the step of heat-sealing the laminate 4, the paper substrate 5 acts as a heat barrier layer and at the high frequency induction heating step, electromagnetic coupling to the intermediate layer on the end edge is blocked because of the presence of the metal foil 6 of the lid member, with the result that heat sealing of the intermediate layer 14 and the innermost wall 12 becomes difficult. However, according to the present invention, by virtue of the above-mentioned structural features, a liquid-tight contact is maintained between the intermediate wall 14 and the innermost layer 12 and the cut edge 10*a* is confined assuredly.

Moreover, since the metal foil 6 is interposed between the heat-sealable resin layer 7*a* and the paper substrate 5, incorporation of water vapor bubbles between the heat-sealable resin layer 7*d* of the lid and the heat-sealable resin layer 7*a* on the end edge portion, which layers are very important for attaining the sealing effect, can be prevented effectively and a secure seal can be formed.

In the present invention, heating of the portion to be heat-sealed can be accomplished advantageously by high frequency induction heating as pointed out above, and compression of this portion is effected by passing the inner wall 19 and outer wall 20 of the lid member having the circumferential end edge portion 15 interposed therebetween through a pair of rollers having a narrow clearance or by pressing the inner wall 19 and outer wall 20 in the state where they are gripped between a pair of male and female split molds.

A thermoplastic resin which does not deteriorate paper and is heat-sealable, especially a thermoplastic resin which is heat-sealable at a temperature of 90° to 300° C., is used as the heat-sealable resin in the present invention. As preferred examples, there can be mentioned olefin resins such as low density polyethylene, medium density polyethylene, high density polyethylene, crystalline polypropylene, a crystalline propylene-ethylene copolymer, a propylene-butene-1 copolymer, an ethylene-vinyl acetate copolymer, an ion-crosslinked olefin copolymer and an acid-modified olefin resin, though resins that can be used in the present invention are not limited to those exemplified above. Moreover, homopolyesters, copolyesters, homopolyamides and copolyamides may be used if the heat sealing temperature is within the above-mentioned range.

It is preferred that the thickness of the heat-sealable resin layers 7*a* and 7*b* of the laminate for formation of the barrel be 20 to 70 microns, especially 30 to 50 microns. In view of the adaptability to the heat sealing operation, it is preferred that the thickness of the heat-sealable resin layer 7*d* of the laminate for formation of the lid member be larger than the thickness of the resin layers 7*a* and 7*b* and be 30 to 150 microns, especially 50 to 100 microns. Moreover, it is preferred that the thickness of the heat-sealable resin tape 11 for covering the side seam be 20 to 200 microns, especially 30 to 150 microns.

Of course, a laminate of a heat-sealable resin tape and a metal foil may be used instead of the heat-sealable resin tape as the covering tape 11.

A paper substrate capable of imparting a shape-retaining property to the cylindrical barrel in combination with the metal foil and the heat-sealable resin is used in the present invention. Ordinarily, a vessel board such as a cup board having a basis weight of 100 to 500 $g/m^2$, especially 200 to 350 $g/m^2$, is used.

An aluminum foil having a thickness of 7 to 30 microns, especially 9 to 15 microns, is preferably used as the metal foil of the laminate for formation of the barrel. Furthermore, a steel foil, an iron foil or a tinplate foil may be used according to need. The surface of the metal foil may be chemically treated with a phosphate and/or a chromate. From the viewpoint of rigidity, it is preferred that the thickness of the metal foil of the laminate for formation of the lid member be larger than the thickness of the metal foil of the laminate for formation of the barrel and be 50 to 200 microns, especially 80 to 150 microns.

In the case where the bondability between the metal foil and the heat-sealable resin is insufficient, they may be bonded through an isocyanate type adhesive, an epoxy type adhesive or an acid-modified olefin resin.

As the protecting resin layer for protecting the outer surface of the lid member, there can be mentioned, for example, plastic films such as a biaxially oriented polyester film, a biaxially oriented nylon film and a biaxially oriented polypropylene film, and resin coatings of an epoxy-phenol type varnish, and epoxy-amino epoxy urea type varnish, an epoxy-acrylic varnish and a polyester varnish.

Incidentally, the lid member is formed by punching the laminate in a predetermined shape and press-formed into a shape as shown in FIG. 3. Of course, a known easy-open mechanism may be formed on the lid member.

The present invention may be applied to sealing of not only the above-mentioned cylindrical barrel having openings on both the ends but also a so-called cup-shaped straight or tapered vessel barrel having a bottom plate fitted into one end portion with a lid member.

Instead of the above-mentioned method in which the circumferential end edge portion 15 of the barrel 1 engaged with the groove 21 of the lid member 3 is compressed in the radial direction and heat sealing is carried out under high pressure, there may be adopted a method in which the outer end portion 23 (see FIG. 3) of the groove 21 of the lid member 3 is inwardly bent, the circumferential end edge portion 15 engaged with the groove 21 is compressed in the axial direction and heat sealing is carried out under compression.

Figures 1, 2, 7, 8, 9:
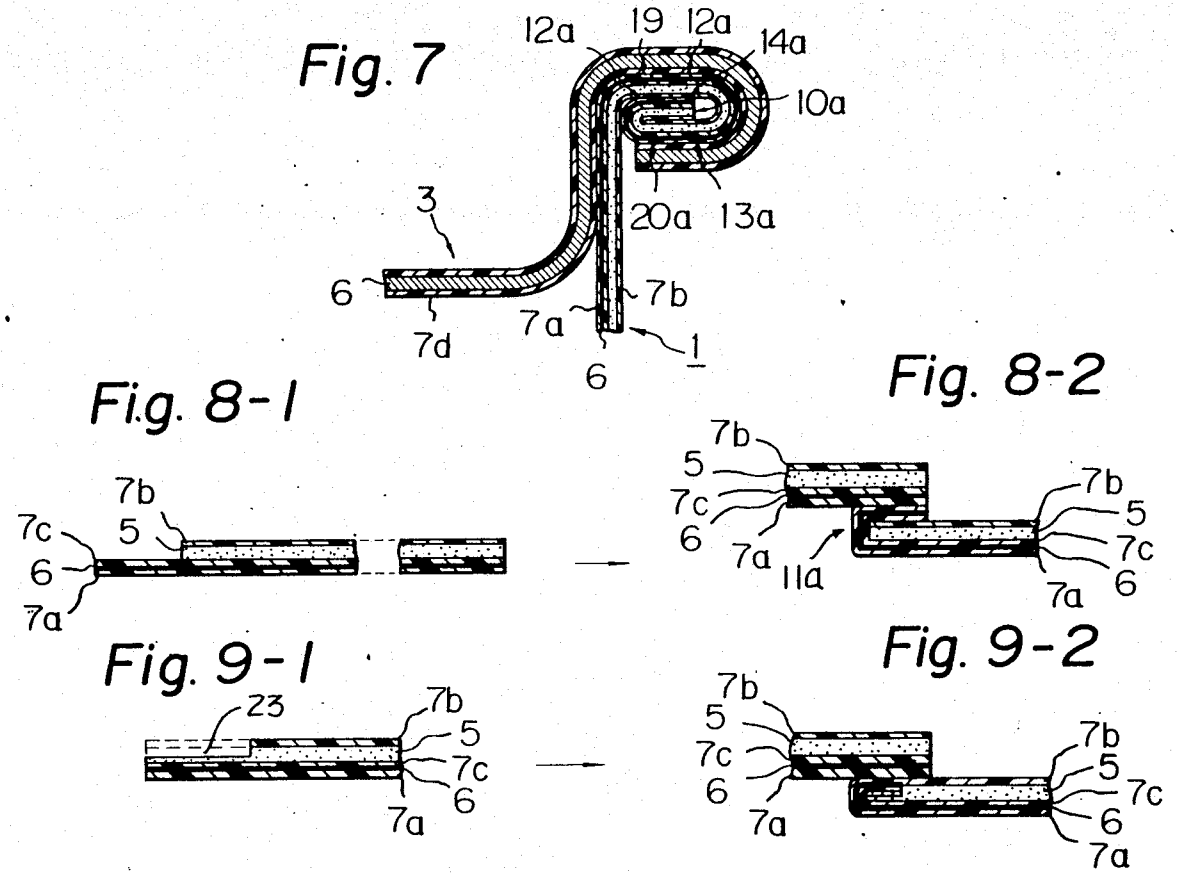

Referring to FIG. 7 illustrating this embodiment, the laminates for the barrel 1 and the lid member 3 are the same as those shown in FIGS. 2 and 3, and a secure seal is formed between the heat-sealable resin layer 7*d* of the top wall 19 of the lid member and the heat-sealable resin layer 7*a* of the topmost wall 12*a* in the end edge portion and between the heat-sealable resin layer 7*d* of the lower wall 20*a* of the lid member and the lowermost wall 13*a* in the circumferential end edge portion by heat sealing under a high pressure. Furthermore, under such high pressure conditions, a liquid-tight contact is assuredly formed between the heat-sealable resin layer 7*a* of the topmost wall 12*a* in the end edge portion contiguous to the cut edge 10*a* of the laminate for the barrel and the heat-sealable resin layer 7*a* of the topmost wall 12*a* in the end edge portion. Accordingly, also in the embodiment illustrated in FIG. 7, a uniform and secure seal is formed along the entire circumference by heat sealing irrespectively of the presence of the steps. Furthermore, the cut edge 10*a* of the laminate is completely separated from the outer atmosphere and the content in the state where the cut edge 10*a* is completely surrounded by the metal foil 6 and heat-sealable resin layers, with the result that excellent seal-retaining property and barrier property can be obtained.

In the present invention, known means may be adopted for covering the side seam of the barrel of the vessel. For example, as shown in FIGS. 8-1 and 8-2, the laminate comprising the heat-sealable resin layers 7*a* and 7*c* and the metal foil 6 is protruded from the cut edges of the paper substrate 5 and the inner resin layer 7*b*, and the protruded end edge is bent and folded to wrap the cut edge of the paper substrate 5, whereby a covering layer 11*a* covering the inner cut edge of the seam is formed.

Furthermore, there may be adopted a method in which, as shown in FIGS. 9-1 and 9-2, parts of the inner resin layer 7*b* and paper substrate 5 in the vicinity of the cut end edge are cut out to form a notched portion 23 having a step and the thinned paper substrate 5, resin layer 7*c*, metal foil 6 and resin layer 7*a* are bent and folded into this notched portion 23 to prevent exposure of the cut edge of the laminate and protect the cut edge of the laminate.

Figure 10:
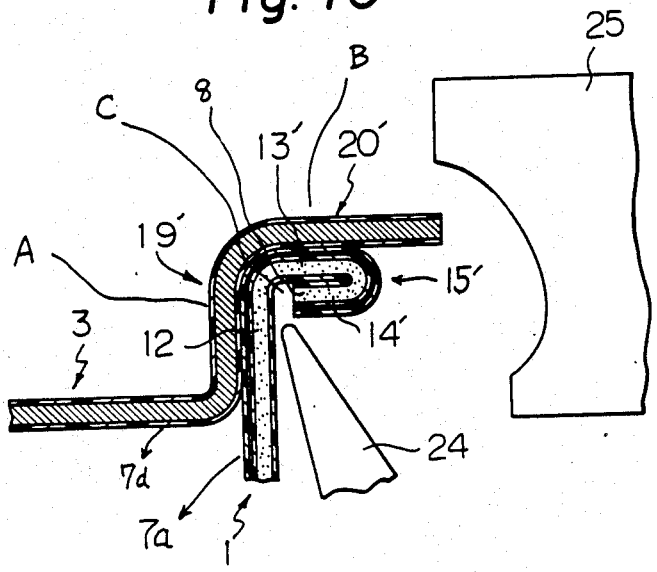
FIG. 10 is a vertically enlarged sectional view showing the engaging portion between the barrel and lid member after heat sealing but deformation.

In the present invention, instead of the above-mentioned method in which a lid member having a circumferential groove formed thereon in advance is used and a barrel having a circumferential end edge portion having a triple-wall structure is used, there may be adopted a method in which the groove of the lid member and the circumferential end edge portion having a triple-wall structure are formed after heat sealing. This embodiment is illustrated in FIG. 10. The lid member 3 has a vertical rim-like inner wall 19' and a horizontal flange wall 20' to be formed into an outer wall. On the other hand, the barrel 1 has a circumferential end edge portion 15' comprising a flat flange wall 13' to be formed into an outermost wall, which is formed by outwardly bending the innermost wall 12, and an inwardly bent portion 14' to be formed into an innermost wall, which is bent so that it is lapped on the lower side of the flange wall 13'. In this state, the lid member 3 and the circumferential end edge portion 15' of the barrel are heat-sealed under compression by such means as high frequency induction heating. After completion of the heat sealing operation, the base of the flange portion of the barrel is supported by a pressing roller 24 having a tapered section, and the lid member and the flange portion of the barrel are engaged with a molding roller 25 having a section agreeing with the final shape of the sealed portion. The molding roller 25 is strongly pressed to the lid member and barrel and simultaneously, the pressing roller 24 is taken out. By this operation, the flange walls 20', 13' and 14' are downwardly bent to form a groove 20 on the lid member and bring about a triple-wall structure in the circumferential end edge portion 15', whereby a shape shown in FIG. 5 is given. This embodiment is advantageous over the method shown in FIG. 3 in that heat sealing is uniformly effected and the sealing property is further improved.

Figure 11:
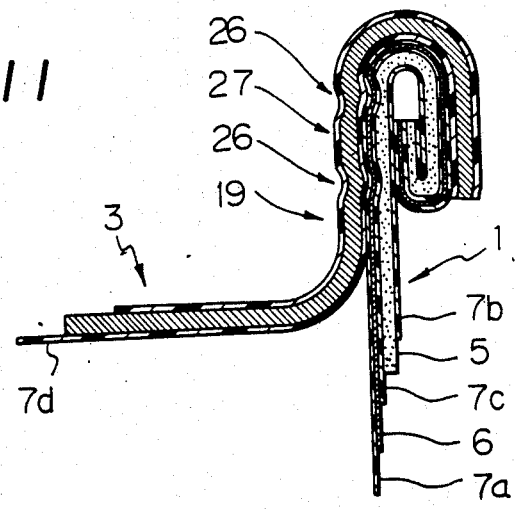
FIG. 11 is an enlarged sectional view showing a part of another example of the engaging and sealing portion in the vessel shown in FIG. 1.

In accordance with still another embodiment of the present invention shown in FIG. 11, a plurality of grooves 26 are formed at small intervals on the inner wall portion 19 of the lid member 3 so that the heat-sealable resin layer 7*d* of the lid member 3 and the heat-sealable resin layer 7*a* of the barrel 1 can be strongly pressed and heat-bonded together, and weakly bonded portions or non-bonded portions are formed between every two adjacent grooves 26. In this embodiment of the present invention, a plurality of grooves 26 are formed to extend in optional directions intersecting the circumferential belt-like heat-sealed portion and the corresponding weakly bonded or non-bonded portions 27 are formed between every two adjacent grooves 26.

In this embodiment of the present invention, by dint of the above-mentioned structural feature, prominent advantages can be attained with respect to the sealing reliability and the adaptability to the sealing operation. More specifically, since the strongly bonded portions defined by the grooves 26 and the weakly bonded or non-bonded portions 27 present between every two adjacent grooves 26 are alternately formed in the engaging area where the peripheral portion of the lid member and the open end portion of the barrel are to be sealed, even if the content adheres to this engaging area or the engaging area is filled with the content, heat sealing can be performed in the grooves 26 in the state where the content is compressed to the heat sealing interface and excluded therefrom, while the weakly bonded or non-bonded portions 27 act as spare spaces receiving the content excluded from the heat sealing interface, whereby a secure and strong seal can be formed along the entire periphery of the engaging area by heat sealing. Furthermore, in this embodiment of the present invention, since the weakly bonded or non-bonded portions 27 are formed between every two adjacent grooves 26 in optional directions intersecting the circumferential engaging portion, leakage of the content or gas through the weakly bonded or non-bonded portions 27 is effectively prevented.

According to this embodiment of the present invention, even if the liquid content rises up, a seal can be formed by heat sealing by applying the above-mentioned heat-sealing method to the circumferential engaging area of the lid member and barrel. Therefore, it becomes possible for the first time to form a seal according to a method in which the lid member is capped on the vessel barrel filled with a liquid content and heat sealing of both the lid member and the barrel is performed while rotating them in this state, and prominent advantages can be attained with respect to formation of a uniform seal along the entire circumference of the engaging area and increase of the speed of the heat sealing operation.

Figure 12:
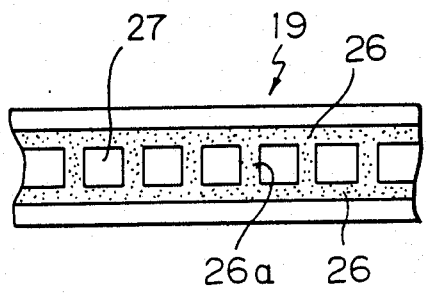
FIG. 12 is an enlarged development diagram showing another example of the groove of the engaging and sealing portion.
Figure 13:
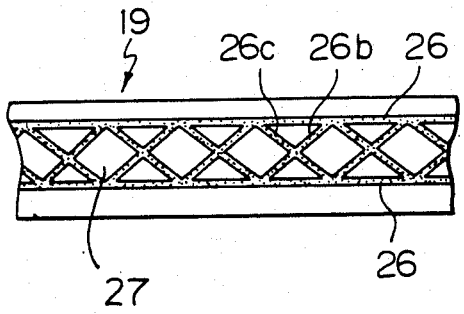
FIG. 13 is an enlarged development diagram showing still another example of the engaging and sealing portion.

In the above-mentioned embodiment of the present invention, the arrangement of the strongly bonded portions defined by the grooves 26 and the weakly bonded or non-bonded portions 27 present between every two adjacent grooves 26 can freely be changed so far as the above-mentioned requirement is satisfied. In the embodiment shown in FIG. 11, two annular grooves 26 are formed and a single weakly bonded or non-bonded portion 27 is formed between the grooves 26. From the viewpoint of prevention of leakage, it is preferred that the weakly bonded or non-bonded portion 27 be divided into segments as small as possible. In a preferred example shown in FIG. 12, in addition to two circumferential grooves 26, short grooves 26*a* extending in the axial direction are formed at small intervals and the weakly bonded or non-bonded portion 27 is divided into small segments. In an example shown in FIG. 13, many combinations of cross-hatched grooves 26*b* and 26*c* are arranged at small intervals between two circumferential grooves 26.

In the above-mentioned embodiment, the depth of the grooves is not particularly critical so far as it is possible to compress and exclude the content present on the interface to be heat-sealed and also to fusion-bond and integrate the heat-sealable resin layers together. In order to attain the objects of the present invention advantageously, it is ordinarily preferred that the depth of the grooves be 0.1 to 1.0 mm, especially 0.3 to 0.7 mm, though the preferred depth differs to some extent according to the layer structure of the laminate. In order to confine a foreign substance present on the heat sealing interface effectively, it is preferred that the interval between the grooves be 0.5 to 3.0 mm, especially 1.0 to 2.0 mm.

The process for the production of a sealed vessel having the heat-sealed structure shown in FIG. 11 will now be described with reference to FIGS. 14-A through 14-C. At first, a U-shaped groove 20 of the lid member 3 is engaged with an open end 15 of the vessel barrel 15 (see FIG. 14-A). The assembly of the members 1 and 3 is supported on a support 28 which can be rotated and driven, and a heating mechanism 30 such as a high frequency induction heating coil 30 is arranged in the vicinity of an engaging area 29 of the open end 15 and the U-shaped groove 20 (see FIG. 14-B). When the support 28 is rotated in this state, metal foils present in the engaging area are heated by induction heating and heat-sealable resin layers contiguous to the metal foils are heated at a temperature where heat sealing is possible.

Then, as shown in FIG. 14-C, the heated engaged area 29 is forcibly engaged with a projection-provided roller 31 which can be rotated and driven and a pressing roller 32. Projections 33 corresponding to grooves 26 to be formed in the engaging area 29 are formed at small intervals on the surface of the projection-provided roller 31, and the clearance between the projection-provided roller 31 and the pressing roller 32 is adjusted so that compression or exclusion of the content or other foreign substance and strong fusion bonding of heat-sealable resin layers can be performed in the heat sealing interface corresponding to the projections 33.

As is seen from the foregoing illustration, according to the above-mentioned embodiment of the present invention, even under conditions where a content adheres to the portion to be heat-sealed or the content is caused to rise up, a reliable seal can be formed assuredly by heat sealing at a high operation speed.

Of course, the clearance between the projection-provided roller 31 and the pressing roller 32 may be such that the clearance between the projections 33 of the roller 31 and the pressing roller 32 is smaller than the total thickness of the laminates present in the engaging area and hence, the heat-sealable resin present in this area is protruded into the weakly bonded or non-bonded portions 27 formed between every two adjacent grooves 26.

The present invention will now be described in detail with reference to the following examples that by no means limit the scope of the invention.

EXAMPLE 1

A covering heat-sealable resin layer 11 of medium density polyethylene having a thickness of 50 μm, shown in FIG. 2, was bonded to a laminate blank for a barrel 1 comprising an innermost layer *7a* of medium density polyethylene having a thickness of 50 μm, a layer 6 of a soft aluminum foil having a thickness of 15 μm, a layer *7c* of low density polyethylene having a thickness of 30 μm, a layer 5 of wood-free paper having a basis weight of 220 g/m$^2$ and an outermost layer *7b* of low density polyethylene having a thickness of 50 μm to obtain a straight barrel having an inner diameter of 52 mm and a height of 152 mm and being provided with a lap seam having a width of 6 mm. Both end portions of the barrel were outwardly curled to prepare a vessel barrel having a height of 137 mm. A lid member 3 to be attached to the barrel, which comprised an innermost layer *7d* of medium density polyethylene having a thickness of 50 μm, an intermediate layer 6 of a soft aluminum foil having a thickness of 100 μm and an outermost layer 18 of a biaxially oriented polyester having a thickness of 12 μm, was prepared by the press-forming operation.

Heat sealing from the engaging state shown in FIG. 3 to the state shown in FIG. 5 was effected by passing the assembly of the barrel 1 and lid member 3 through a pair of rollers having a predetermined clearance and heating the assembly by high frequency induction heating. As the content, 250 ml of a juice was hot-filled.

Vessels were prepared in the same manner as described above by using the same blank laminates for the barrel and lid member while changing the clearance between the rollers, and influences of this clearance on the sealing property of the vessel were examined. The obtained results are shown in the following table. It was confirmed that when the above-mentioned value α is appropriately adjusted, good seal-retaining property and barrier property can be obtained.

TABLE

| Clearance (mm) between Rolls | Total Thickness (μ) of Used Heat-Sealable Resin (da + dd + dll) | Resin Thickness (μ) after Heat Sealing (de) | Value α [de/(da + dd + dll)] | Presence of Leakage[1] |
|---|---|---|---|---|
| 2.4 | 150 | 120 | 0.80 | observed (lap step portion) |
| 2.0 | 150 | 80 | 0.53 | not observed |
| 1.8 | 150 | 50 | 0.33 | not observed |
| 1.5 | 150 | 20 | 0.13 | observed (lap step portion) |

Note
da: thickness of heat-sealable resin layer 7a of barrel 1
dd: thickness of heat-sealable resin layer 7d of lid member 3
dll: thickness of heat-sealable resin layer in covering layer 11
de: thickness of heat-sealable resin layer 7e present between metal foil 6 of barrel and metal foil 6 of lid member on each of inner and outer edges of seam after heat sealing
[1]leakage was checked after one month's storage at normal temperature

EXAMPLE 2

A cylindrical straight barrel having the end portion covered as shown in FIG. 8-2, which had an inner diameter of 52 mm and a height of 143 mm, was prepared by heat bonding from a laminate 4 comprising an innermost layer *7a* of medium density polyethylene having a thickness of 50 μm, a layer 6 of a soft aluminum foil having a thickness of 9 μm, a layer *7c* of low density polyethylene having a thickness of 30 μm, a layer 5 of a cup board having a basis weight of 220 g/m$^2$ and an outermost layer of low density polyethylene having a thickness of 50 μm, and a circumferential end edge portion 12 having a diameter of about 3 mm was formed on the end face of each opening and the circumferential end edge portions 15 were compressed in the axial direction to form a cylindrical barrel having a height of 132 mm.

Then, as shown in FIG. 10, a lid member 3 composed of a laminate 17 comprising an inner layer 7*d* of medium density polyethylene having a thickness of 50 μm, an intermediate layer 6 of a soft aluminum foil having a thickness of 100 μm and an outer layer 15 of an epoxy-phenolic coating having a thickness of 5μ was engaged with the so-formed barrel 1, and the side wall A where the inner layer 7*d* of the lid member 3 was contiguous to the innermost layer 7*a* of the barrel 1 and the top wall B were heat-bonded together by high frequency induction heating. Then, as shown in FIG. 10, the heat-bonded flange portion was downwardly bent by the press roll 24 and molding roller 25 and the distance between the inner wall 19' of the lid member 3 and the outer wall 20' of the lid member 3 was adjusted to 1.2 mm. Then, 250 ml of a liquid containing 10% of an orange juice, which was heated at 90° C., was filled into the so-obtained vessel. Sealing was effected in the same manner as described in Example 1, and in order to increase the vitamin C-retaining ratio, the filled vessel was cooled for 6 minutes by sprinkling water maintained at 20° C.

For comparison, a sealed vessel was prepared in the same manner as described above except that the distance between the inner wall 19' and outer wall 20' of the lid member was adjusted to 1.7 mm.

In a water tank, the appearance of the comparative sealed vessel was degraded because of staining or swelling of the paper substrate which was due to permeation of water from the cut edge 8 of the barrel 1, and moreover, water was left in the void of the circumferential end edge portion of the barrel and there was a risk of growing of aqueous mold. In contrast the sealed vessel of the present invention had none of such defects.

We claim:

1. A process for the preparation of a sealed laminated vessel, which comprises (i) applying to a laminate comprising a paper substrate and a metal foil and having heat-sealable resin layers on both the surface portions of the substrate and the foil a heat-sealable resin layer over at least that portion of the laminate to be formed into an inner side of a seam to cover a cut edge of the paper substrate, (ii) forming the laminate into a cylinder so that the metal foil is located on the inner side and the paper substrate is located on the outer side and lap-bonding an inner end of the laminate to an outer end of the laminate by heat sealing to form a barrel having a straight seam on the side surface thereof, (iii) bending outwardly the laminate on at least one open end of the barrel and bending inwardly a part of the bent portion so that it is lapped on the lower side of the remaining part of the bent portion to form a flat circumferential end portion on at least one open end of the barrel, (iv) fitting a lid member on the circumferential end portion of the barrel, said lid member being composed of a laminate comprising a heat-sealable resin layer and a metal foil, said lid member having a peripheral portion for engagement with the circumferential end portion through the heat-sealable resin layer, said lid member having a vertical rim-like inner wall and a horizontal flange wall, (v) heat sealing the lid member and the circumferential end portion of the barrel, and (vi) engaging the lid member and the circumferential end portion of the barrel with a molding roller having a section conforming to the final shape of the sealed portion to downwardly bend the flange wall of the lid member together with the circumferential end portion of the barrel heat-sealed thereto.

2. The process of claim 1 wherein in step (v) the lid member and the circumferential end portion of the barrel are heat-sealed while under compression.

3. The process of claim 1 which further comprises in step (vi) supporting the horizontal flange wall with a pressing roller, pressing strongly the lid member and the circumferential end portion of the barrel with the molding roller and simultaneously removing the pressing roller.

4. The process of claim 1 wherein the steps (v) heat-sealing the lid member and the circumferential end portion of the barrel and (vi) engaging the lid member and the circumferential end portion of the barrel with the molding roller result in the lid member and the circumferential end portion of the barrel being sealed together such that the thickness (de) of the heat-sealable resin layer present between the metal foil layer of the laminate forming the barrel portion and the metal foil of the lid member is from 0.2 to 0.7 times the sum of the thickness, da, of the heat-sealable resin layer of the laminate forming the barrel, the thickness, dd, of the heat-sealable layer of the lid member, and the thickness, d11, of the heat-sealable resin layer overlying the marginal cut edge of the paper substrate, and wherein the step formed by the overlapped multilayer laminate in the outwardly facing seam margin is substantially completely filled up by the heat-sealable resin which has flowed out of the laminate forming the outwardly facing seam margin.

5. The process of claim 4 wherein the thickness of the heat-sealable resin layers on each of the substrate layer and the foil layer of the multilayer laminate forming the barrel portion is in the range of from 20 to 70 microns; the thickness of the heat-sealable resin layer of the lid member is larger than the thickness of the resin layers of the multilayer laminate from the barrel portion and is in the range of from 30 to 150 microns; and the thickness of the heat-sealable resin layer applied to the portion of the laminate to be formed into the inner side of the seam to cover the cut edge of the paper substrate is from 20 to 200 microns.

* * * * *